US006536759B1

(12) United States Patent
Takada

(10) Patent No.: US 6,536,759 B1
(45) Date of Patent: Mar. 25, 2003

(54) SHEET FEEDING APPARATUS, IMAGE FORMING APPARATUS HAVING THE SHEET FEEDING APPARATUS, AND IMAGE READING APPARATUS

(75) Inventor: Hideaki Takada, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/671,158

(22) Filed: Sep. 28, 2000

(30) Foreign Application Priority Data

Sep. 30, 1999 (JP) ..... 11-277910
Aug. 21, 2000 (JP) ..... 2000-249417

(51) Int. Cl.[7] ..... B65H 3/52

(52) U.S. Cl. ..... 271/125; 271/126; 271/127; 271/37

(58) Field of Search ..... 271/122, 124, 271/125, 37, 126, 127

(56) References Cited

U.S. PATENT DOCUMENTS 4,852,868 A * 8/1989 Fukui et al. ..... 271/122
5,350,168 A * 9/1994 Sheridan ..... 271/122
5,655,762 A * 8/1997 Yergenson ..... 271/121
5,927,706 A * 7/1999 HIroi et al. ..... 271/117
6,129,347 A * 10/2000 Brooks et al. ..... 271/122
6,260,840 B1 * 7/2001 Suga et al. ..... 271/10.12

* cited by examiner

*Primary Examiner*—Donald P. Walsh
*Assistant Examiner*—Mark A. Deuble
(74) *Attorney, Agent, or Firm*—Fitzpatrick, Cella, Harper & Scinto

(57) ABSTRACT

A sheet feeding apparatus has a sheet support, a feeding rotary member and a separating rotary member. The sheet support, the feeding rotary member, and the separating rotary member are so disposed that an angle formed on a side of the feeding rotary member by intersecting a tangential line of the feeding rotary member at a contacting position between the feeding rotary member and the sheet with a tangential line at the contact portion is an obtuse angle. A conveyance guide is disposed on a side of the separating rotary member with respect to the contact portion for guiding the sheet fed to the feeding rotary member to the contact portion, the conveyance guide having a projection guide for projecting the contact portion on an upstream side in the sheet conveyance direction of the contact portion more toward the side of the feeding rotary member than a guide surface of the contact portion.

12 Claims, 14 Drawing Sheets

(a) INITIAL POSITION (b) INTERMEDIATE PLATE PRESS COMPLETION POSITION ($\theta$ 1 TERN)

(c) PRE-FEEDING STARTING POSITION (d) PRE-FEEDING COMPLETION POSITION (e) INTERMEDIATE PLATE PRESS PRELEASING COMPLETION POSITION (f) RE-FEEDING STARTING POSITION ($\theta$ 5 TERN)

(g) RE-FEEDING COMPLETION POSITION (INITIAL POSITION/COMPLETION ONE TERN)

(a) INITIAL POSITION
PULLING CLUTCH TURNED ON (b) INTERMEDIATE PLATE 70
PRESSING COMPLETION (c) PRE-FEEDING START (d) PRE-FEEDING COMPLETION (e) INTERMADIATE PLATE 70 RELEASING COMPLETION (f) RE-FEEDING START (g) RE-FEEDING COMPLETION (h) REGISTER LOOP FORMATION COMPLETION

SHEET FEEDING APPARATUS, IMAGE FORMING APPARATUS HAVING THE SHEET FEEDING APPARATUS, AND IMAGE READING APPARATUS

BACKGROUND OF THE INVENTION

1. Field of the Invention

This invention relates to a sheet feeding apparatus in an image forming apparatus such as a photocopier, a printer, or the like or in an image reading apparatus for reading image information formed on sheets.

2. Description of Related Art

FIG. 14 shows a schematic cross section of a sheet feeding apparatus capable of successively feeding sheets in use of an intermediate plate 100, a feeding roller 101, and a separating roller 102 and a Schematic cross section of a separation guide 103. The separation guide 103 formed in having a uniform cross section in a sheet width direction near the separating roller 102 is provided at a certain distance away from a separation nipping portion as a sheet nipping portion at which the feeding roller 101 and the separating roller 102 rotating with a prescribed torque in a direction returning the sheet with the feeding roller 101. A hitting plate 103 extending approximately vertically with respect to the intermediate plate 100 so that the sheet front end stacked on the intermediate plate 100 hits to the plate 103 while the intermediate plate 100 is disengaged is disposed on an upstream side in the sheet feeding direction of the separation guide 103 with respect to the separation nipping portion.

The separation guide 103 has an opening 103*c* to project the separating roller 102 from a guide surface 103*b* to sandwich the sheet with the feeding roller 101 at prescribe pressure. A pulling roller 104 is formed on a downstream side in the sheet conveyance direction of the feeding roller 101, thereby further feeding in the downstream direction the sheet fed from the feeding roller 101.

In feeding operation, where the intermediate plate 100 moves in a direction contacting with the feeding roller 101, the sheets stacked on the intermediate plate 100 come in contact with the feeding roller 101, thereby conveying the front ends of the sheets sent by the feeding roller 101 to the separation nipping portion along the separation guide 103.

The sheets are conveyed toward the pulling roller 104, and when the sheets other than the topmost sheet are sent to the separation nipping portion, the separating roller 102 rotating with a prescribed returning torque reverses the sheets in the direction of the intermediate plate 100 to prevent the plural sheets from being fed at a time. Where a single sheet is nipped at the separation nipping portion, the separating roller 102 rotates in the conveyance direction according to the rotation force of the feeding roller 101.

In the sheet feeding apparatus thus structured, however, if sheets having a high rigidity and a large frictional coefficient between the sheets are fed, sheets next to the topmost and below may enter in the nipping portion when the sheets enter in the separation nipping portion, and the sheet front end hits the outer peripheral surface of the separating roller in the center direction (or normal direction) of the separating roller, giving the separating roller 102 force in a direction of arrow F, thereby pushing down the separating roller 102 to isolate from the feeding roller 101.

Where the separating roller 102 separates from the feeding roller 101 and where the front ends of the sheets next to the topmost and below hit the separating roller 102, the nipping force for nipping the sheets with the feeding roller 101 and the separating roller 102, or separation pressure that the separating roller 102 contacts in pressure with the feeding roller 101 is greatly reduced. Where the separation pressure is reduced, the separating roller 102 cannot rotate in following the rotation of the feeding roller 101 and the conveyance of the topmost sheet and may rotate in the returning direction. The feeding roller 101 thereby cannot feed the sheet further, so that the sheets cannot be conveyed to pulling roller 104.

Where the sheets are conveyed from the separation nipping portion, if the sheet has a high rigidity, the sheets are conveyed in a state that the separating roller 102 are pushed down in a direction separating from the feeding roller 101. That is, the sheets are conveyed in the direction as sinking down in a direction of arrow F. The separation guide 103 has the opening 103*c* only for the roller width of the separating roller 102, so that the sunken sheet front end may hit an end 103*d* of the opening 103*c* of the separation guide 103 and may cause paper jamming.

This invention is conceived to solve the above problems. It is an object of the invention to provide a sheet feeding apparatus capable of stably feeding sheets without any conveyance failure even where sheets having a high rigidity or having a large frictional coefficient between the sheets are conveyed.

SUMMARY OF THE INVENTION

A representative structure of the invention to accomplish the above objects includes sheet supporting means movable for supporting a sheet or sheets; a feeding rotary member in contact with the sheet supported by the sheet supporting means to feed out the sheet upon rotation of the feeding rotary member; and a separating rotary member forming a contact portion in contact with the feeding rotary member and being rotatable in a direction returning the sheet to separate the sheet fed out of the feeding rotary member, wherein the sheet supporting means, the feeding rotary member, and the separating rotary member are so disposed that an angle formed on a side facing to the feeding rotary member by intersecting a tangential line of the feeding rotary member at a contacting position between the feeding rotary member and the sheet with a tangential line at the contact portion is an obtuse angle, and further includes a conveyance guiding means disposed on a side of the separating rotary member with respect to the contact portion for guiding the sheet fed to the feeding rotary member to the contact portion, the conveyance guiding means having a projection guiding means for projecting the contact portion on an upstream side in the sheet conveyance direction of the contact portion more toward the side of the feeding rotary member than a guide surface of the contact portion.

BRIEF DESCRIPTION OF THE DRAWINGS

FIG. 11(*b*) is a perspective illustration of a separating auxiliary guide;

DETAILED DESCRIPTION OF THE PREFERRED EMBODIMENTS

A sheet feeding apparatus according to an embodiment of the invention is described in detail with an example in which the apparatus is used for a photocopier as an image forming apparatus.

First, an outline of the image forming apparatus having the invented sheet feeding apparatus is described.

Figure 1:
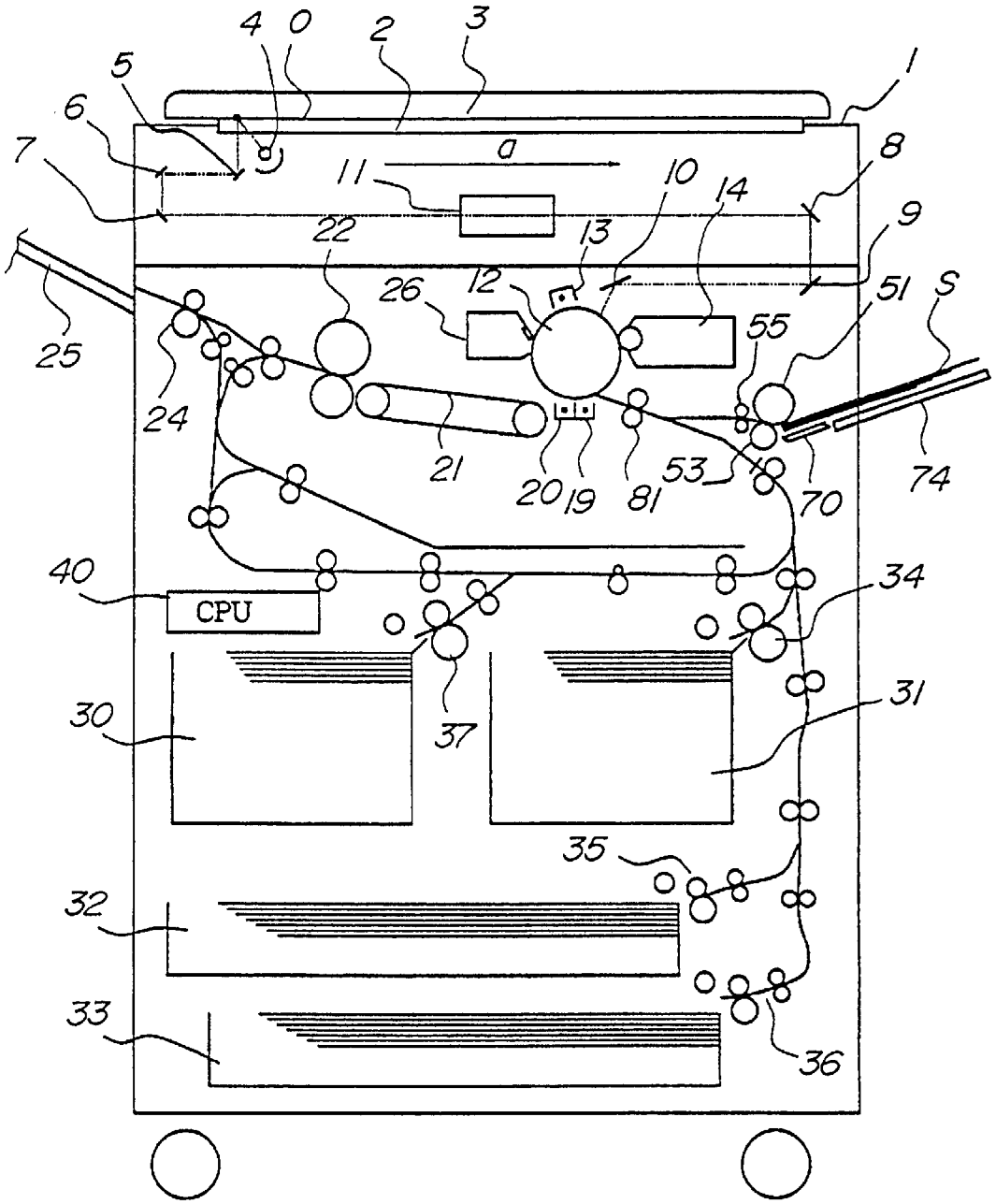
FIG. 1 is a schematic cross section of a photocopier having a feeding apparatus according to an embodiment of the invention.

FIG. 1 is a schematic cross section of a photocopier serving as the image forming apparatus. In FIG. 1, numeral 1 is a photocopier member. An original document plate 2 made of a glass plate is immovably formed on a top of the photocopier member 1. Numeral 3 is an original document pressing plate, which presses and immobilizes an original document O placed on a prescribed position of the original document plate 2 as the image surface faces down.

Disposed below the original document plate 2 is an optical system including a lamp 4 for illuminating an original document O, reflecting mirrors 5, 6, 7, 8, 9, 10 for guiding light images from the illuminated original document O to a photosensitive drum 12, and a lens 11. It is to be noted that the lamp 4 and the reflecting mirrors 5 to 7 move at a prescribed rate in a direction of arrow a to scan the original document O.

In a feeding section, formed are cassette feeding sections 34, 35, 36, 37 for feeding, to an image forming section, sheets stacked on sheet cassettes 30, 31, 32, 33, respectively, incorporated in the photocopier member 1, and a feeding section (hereinafter referred to as "multi-feeding section") for feeding a sheet or sheets in a variety of materials and sizes successively from a feeding tray 74 to the image forming section.

The image forming section includes a photosensitive drum 12, a charger 13 for charging uniformly the surface of the photosensitive drum 12, a developing device 14 for developing electrostatic latent images formed from light images irradiated from the optical system on the surface of the photosensitive drum 12 charged by the charger 13 and forming toner images to be transferred to the sheet S, a transfer charger 19 for transferring to the sheet S the developed toner images on the surface of the photosensitive drum 12, a separation charger 20 for separating the sheet S on which the toner images are transferred from the photosensitive drum 12, and a cleaner 26 for removing toners remaining on the photosensitive drum 12.

Disposed on a downstream side of the image forming apparatus are a conveyance section 21 for conveying sheets S to which the toner images are transferred and a fixing device 22 for fixing images, as permanent images, on the sheet S conveyed by the conveyance section 21. A delivery roller 24 is formed for delivering the sheet S, to which the images are fixed at the fixing device 22, out of the photocopier member 1. A delivery tray 25 is provided outside the photocopier member 1 to receive the sheets S delivered by the delivery roller 24.

The multi-feeding section of the image forming apparatus is described in detail next.

Figure 2:
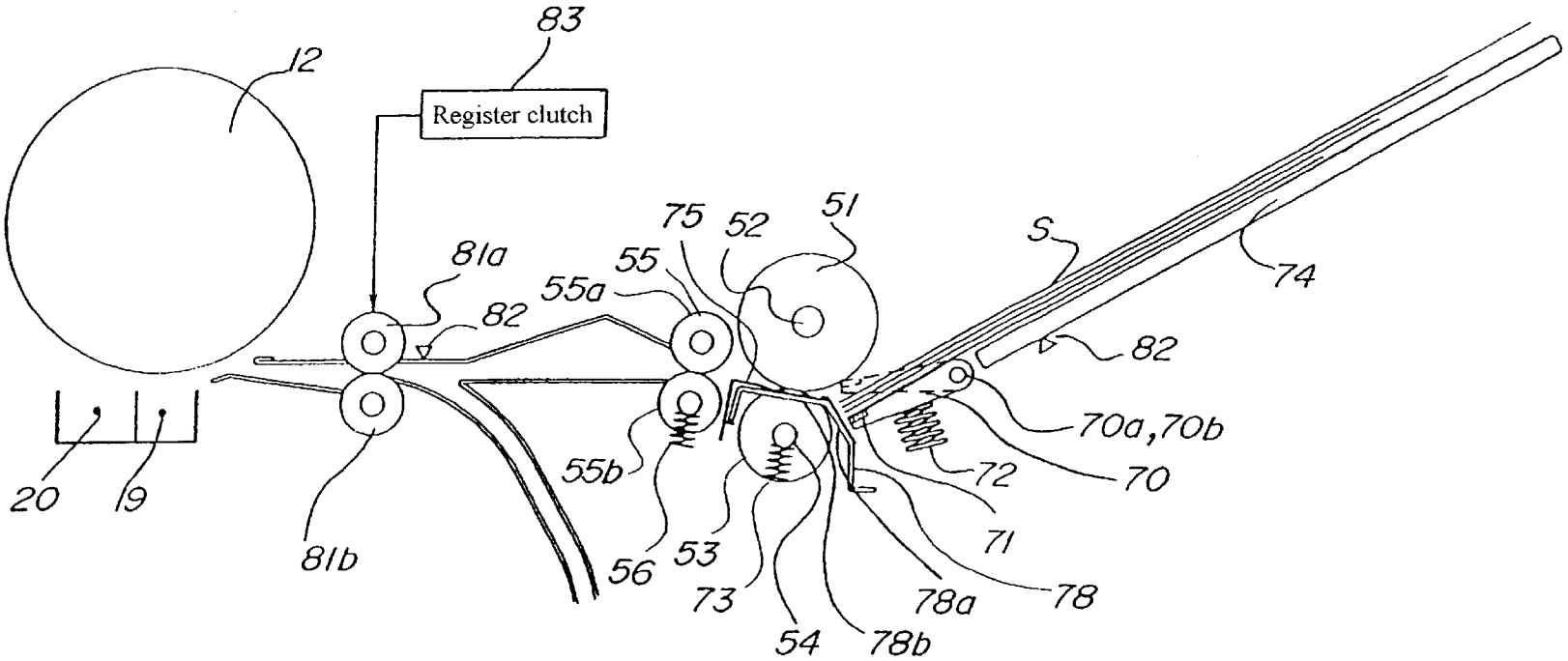
FIG. 2 is a cross section of an essential portion of a manual feeding apparatus according to the embodiment of the invention.
Figure 3:
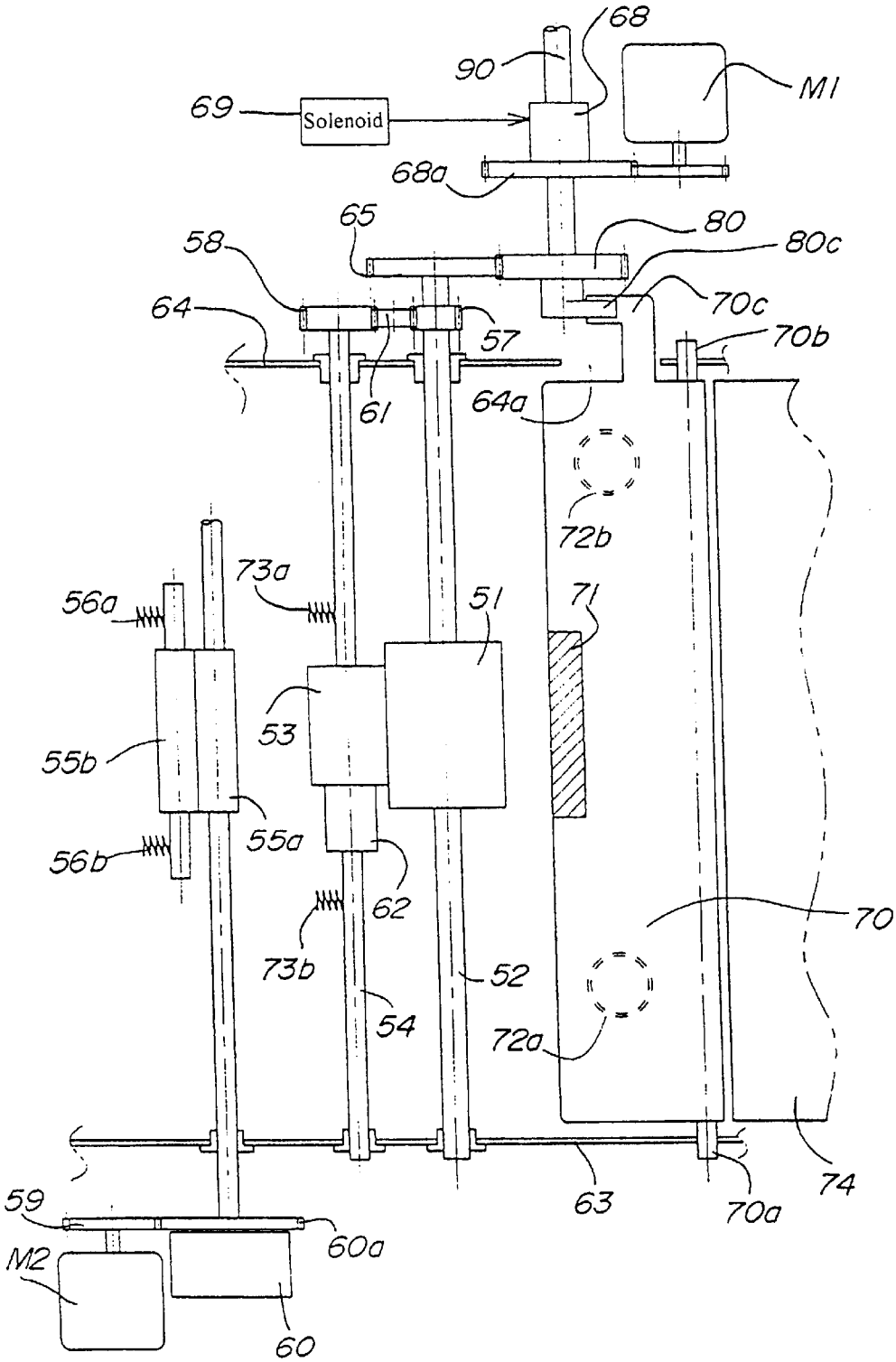
FIG. 3 is an illustration extendedly showing a drive line of the manual feeding apparatus according to the embodiment of the invention.

FIG. 2 is a cross section of the multi-feeding section and the drum portion; FIG. 3 is an illustration extendedly showing a drive line of the multi-feeding section. In the photocopier member 1, the multi-feeding tray 74 is formed for stacking and supporting the sheet bundle. A sheet detection sensor 82 made of a photo-interrupter is formed for detecting whether the sheet S exists on the tray 74.

An intermediate plate 70 serving as a sheet supporting means is formed as to move pivotably around axes 70*a*, 70*b* as centers with respect to a front side plate 63 and a rear side plate 64, and receives a moment in a clockwise direction in FIG. 2 (or a direction for pressing the feeding roller 51) by pivotal movement springs 72*a*, 72*b* (72) as pressing and isolating means. The intermediate plate 70 can press (in a state of a broken line in FIG. 2) and release the supported sheets (in a state of a solid line in FIG. 2) with respect to the feeding roller 51 as a feeding rotary member by the pressing and isolating member as described below.

A felt 71 is arranged at a contact portion of the tip portion of the intermediate plate 70 in contact with the feeding roller 51 to prevent the sheet S from being doubly fed and to soften an impact of the intermediate plate 70 during press to the feeding roller 51.

The feeding roller 51 as a feeding rotary member is secured to the feeding roller shaft 52, and the feeding roller shaft 52 is rotatively supported to the front side plate 63 and the rear side plate 64.

A feeding drive gear 65 and a drive transmission gear 57 as connecting means are secured to a rear side end of the feeding roller shaft 52. A drive gear 58 connected to the drive transmission gear 57 of the feeding roller shaft 52 and an idler gear 61 to receive the drive force is secured to a separating roller shaft 54, and therefore, the separating roller shaft 54 rotates in the same direction as the feeding roller shaft 52 in synchrony with the rotation of the feeding roller shaft 52. A control gear 80 serving as transmitting means having two cutout portions 80*a*, 80*b* as non-engagement portions (see, FIG. 4) is provided in mesh with the feeding drive gear 65 at a position facing to and meshing with the feeding drive gear 65.

A cam 80*c* serving as the pressing and isolating means is formed in a united body with the control gear 80 to press and release the sheets supported by the intermediate plate 70 to and from the feeding roller 51.

A cam follower 70*c* serving as the pressing and isolating means comes in contact with the cam 80*c* in being made in a united body with the intermediate plate 70 to extend to the contact position to the cam 80*c* in penetrating a hole 64 formed in the rear side plate 64, and thereby, the rotation of the intermediate plate 70 in the clockwise direction in FIG. 2 is restricted. The control gear 80 is secured to a drive shaft 90 formed with a spring clutch 68 as a rotation regulating means. The spring clutch 68 controls for one turn upon turning on for T1 (sec) a solenoid for control 69 of the spring clutch 68. The phase angles of the spring clutch 68 and the cutout portion 80*a* are so normally selected that the cutout portion 80*a* of the control gear 80 takes a position opposing to the feeding drive gear 65.

This structure allows the feeding drive gear 65, the feeding roller shaft 52, and the feeding roller 51 rotating in either direction though subject to exertion of rotational load of a torque limiter 62.

A pulling roller pair 55 as conveying means is disposed on a downstream side in the sheet conveyance direction of the feeding roller 51. The drive shaft of the pulling drive roller 55*a* is rotatably supported to the front and rear side plates 63, 64 with bearings not shown, and a pulling clutch 60 made of an electromagnetic clutch is provided at the end of the pulling drive roller 55*a,* thereby rendering the drive from the pulling motor M2 through gears 59, 60 connecting and disconnecting.

A pulling driven roller 55*b* presses the pulling drive roller 55*a* with springs 56*a,* 56*b* (56) through bearings not shown in facing to the pulling drive roller 55*a*.

A separating roller 53 as separating rotary member is formed rotatably at a separating roller shaft 54 in placing therebetween the torque limiter 62 generating a prescribed torque. The separating roller 53 is provided as to face with the feeding roller 51 and is structured to press the feeding roller 51 with prescribed separating pressure by means of springs 73*a,* 73*b* (73) in placing therebetween bearings not shown.

The torque amount of the torque limiter 62 and the separation pressure of the pivotal movement springs 73*a,* 73*b* of the separating roller 53 are selected respectively so that the separating roller 53 follows the feeding roller 51 due to frictional force in a case that a single sheet only exists or no sheet exists in a nipping portion formed by the feeding roller 51 and the separating roller 53 (or stops in a case that the feeding roller 51 stops) and so that the separating roller 53 moves reverse to generate returning force in a case that the two or more sheets exist in the nipping portion.

A separating guide 78 serving as a conveyance guiding means, which operates as an alignment portion when a user sets sheets on the feeding tray, and also as a sheet guide, is secured between the separating roller 53 and the intermediate plate 70. A separating auxiliary guide 75 as a conveyance guiding means is formed as an auxiliary guide formed of a polyethylene sheet or a thin plate made of such as an SUS material for guiding the front end of the sheet to the nipping portion formed of the feeding roller 51 and the separating roller 53. This prevents the front end of the sheets from wound or folded upon hitting the separating roller 53.

The intermediate plate 70, the feeding roller 51, and the separating roller 53 are so disposed that an angle formed on a side facing to the feeding roller 51 by intersecting a tangential line of the feeding roller 51 at a contacting position between the feeding roller 51 and the sheet with a tangential line at the contact portion (nipping portion) between the feeding roller 51 and the separating roller 53 is an obtuse angle Subsequently, the structure of transmitting means and pressing and isolating means in the feeding roller 51 and the intermediate plate 70 is described in detail.

As described above, the control gear 80 is formed in a united body with the first and second gear portions 80*d,* 80*e* in mesh with the feeding drive gear 65, the two cutout portions 80*a,* 80*b,* and the cam 80*c* for pressing and releasing the intermediate plate 70 to and from the feeding roller 51. The control gear 80 is structured, as described above, to control one turn by the spring clutch 68 and the solenoid 69. The structure of the spring clutch 68 is not related to the essence of the invention, and any detailed description is omitted.

Because in the initial state the control gear 80 has the phase angle of the spring clutch 68 and the shape and position of the first cutout portion 80*a* so selected that the first cutout portion 80*a* faces to the feeding drive gear 65, the feeding roller shaft 52 is rotatable in the sheet conveyance direction as well as in the reverse direction.

The cam 80*c* is in contact with the com follower 70*c* provided at an end of the intermediate plate 70 and in the initial state has a cam shape and a phase angle to the cutout portion 80*a* so selected as to keep the intermediate plate 70 away from the pivotal movement spring 72. Thus, when a user sets a sheet bundle, the intermediate plate 70 is released from pushing to the feeding roller 51 and enable the sheet bundle to be set up to hit the separating guide 78 easily.

Subsequently, feeding operation and separating operation done by the above transmitting means and the pressing and isolating means are described.

When the solenoid 69 is turned on for T1 (sec), the control gear 80 begins rotating by operation of the spring clutch 68. The control gear 80 begins rotating in the counterclockwise direction in FIG. 4, and the cam 80*c* rotates from the intermediate plate isolating position to an intermediate plate pressing position θ1. According to this move, the cam 80*c* and the cam follower are isolated from each other, and the intermediate plate 70 shifts as to press the feeding roller 51. This makes the topmost sheet S of the sheet bundle stacked on the feeding tray 74 to be pressed on the feeding roller 51 (see, a state shown in FIG. 4(*b*) and FIG. 5(*b*)).

Where the control gear rotates up to an angle θ2, the first gear portion 80*d* arranged at the control gear 80 comes in mesh with the feeding drive gear 65, so that the feeding drive gear 65 rotates by a predetermined angle A°. According to this rotation, the feeding roller 51 rotates by angle A°, and the topmost sheet S of the sheet bundle is fed by a predetermined amount L1 (hereinafter, the feeding operation up to this is referred to as "pre-feeding operation")(see, state shown in FIG. 4(*c*), (*d*) and FIG. 5(*c*), (*d*)).

The feeding amount Li during the pre-feeding operation is given from:

$$L1 = A^\circ \times \pi \times D / 360^\circ \qquad \text{(Formula A)}$$

where an outer diameter D of the feeding roller 51.

Figure 4:
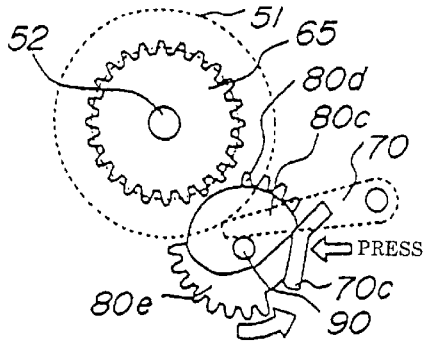
FIG. 4 is a diagram of control gears in a state during control according to the embodiment of the invention.
Figure 4:
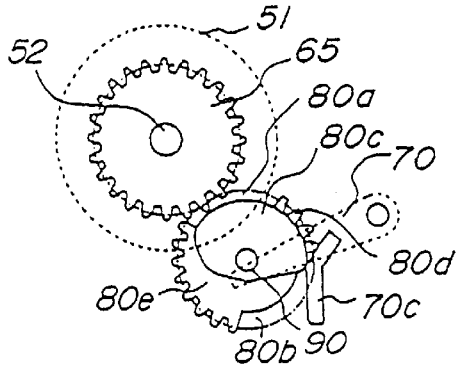
Figure 4:
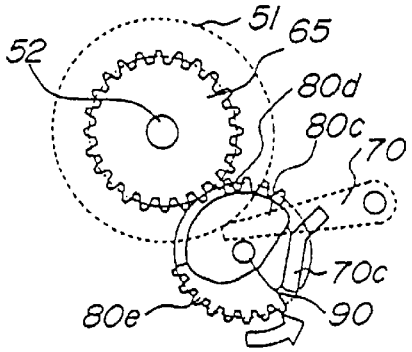
Figure 4:
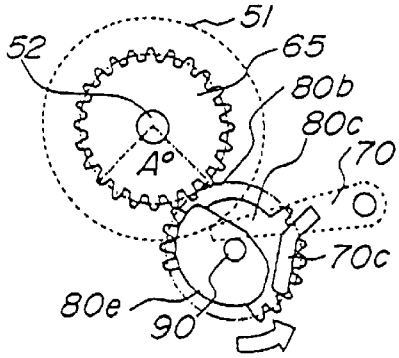
Figure 4:
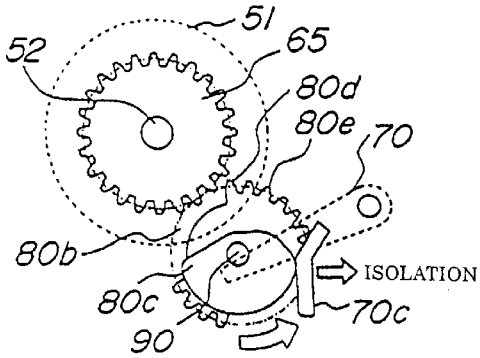
Figure 4:
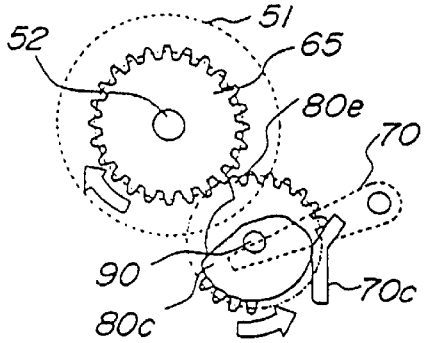
Figure 4:
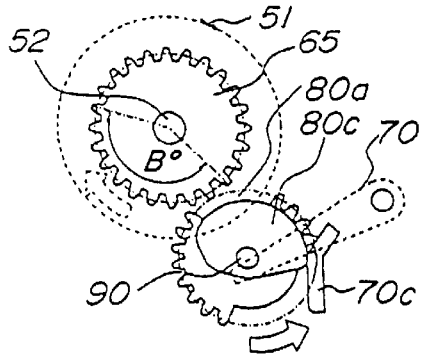
Figure 5:
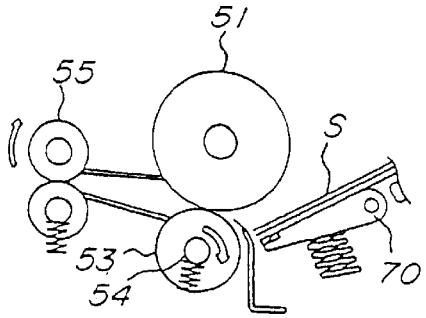
FIG. 5 is a diagram showing the manual feeding apparatus in a state during control according to the embodiment of the invention.
Figure 5:
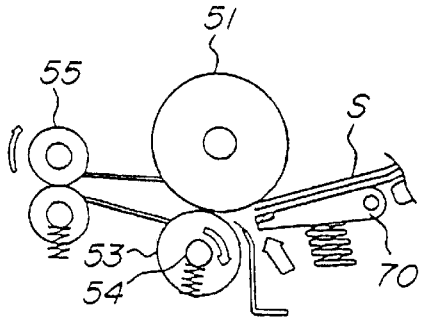
Figure 5:
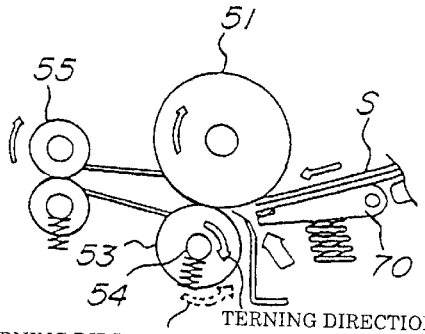
Figure 5:
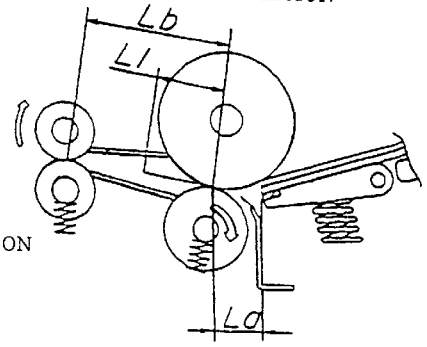
Figure 5:
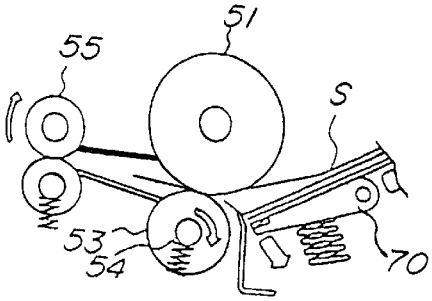
Figure 5:
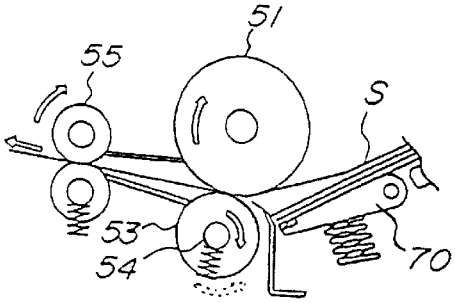
Figure 5:
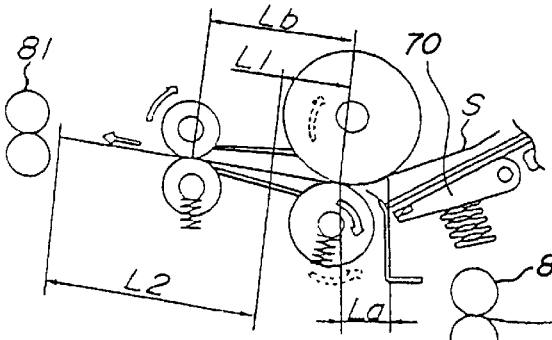
Figure 5:
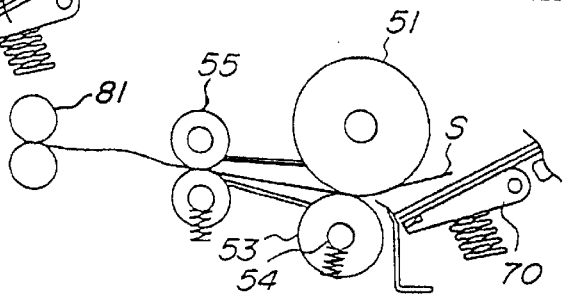

The tooth number is selected so that the sheet feeding amount L1 during the pre-feeding operation is an amount to more convey the sheets than a distance La from the sheet separating guide 78 to the nipping portion formed by the feeding roller 51 and the separating roller 53 and less convey the sheets than a distance Lb from the nipping position to the pulling roller pair 55. As for the rotation speed of the feeding drive gear 65 at that time, the rotation speed of the feeding motor M1, and tooth numbers and roller diameters of respective gears such as transmission gears for transmitting drive force are so selected that the sheet feeding speed made by the feeding roller 51 becomes equal to the feeding speed made by the pulling roller pair 55 and the register roller pair 81.

Where the control gear 80 continues to rotate up to angle θ3, and where the second cutout portion 80*b* reaches the facing meshing position of the feeding drive gear 65 (state shown in FIG. 4(*d*) and FIG. 5(*d*)), drive force is not transmitted to the feeding drive gear 65, and the feeding roller 51 stops the rotation temporarily. The tooth number of the first gear 80*d* is selected as described above, the front end of the sheet D fed by the amount L1 by the pre-feeding operation can surely be stopped temporarily between the nipping portion and the pulling roller pair 55 even where the feeding starting position of the sheet S is.

Subsequently, where the control gear 80 rotates up to the angle θ4, and where the cam 80*c* returns to the intermediate plate isolating position, the cam 80*c* comes in contact with the cam follower 70*c,* thereby releasing the intermediate plate 70 from pressing to the feeding roller 51 (state shown in FIG. 4(*e*) and FIG. 5(*e*)).

Where the control gear 80 rotates up to the angle θ5, and where the second gear portion 80*e* of the control gear 80 engages with the feeding drive gear 65 (state shown in FIG. 4(*f*) and FIG. 5(*f*)), the feeding drive gear 65 restarts rotating to rotate only by a predetermined angle B°, and according to this rotation, the sheet conveyance is restarted by the feeding roller 51 (hereinafter, this feeding operation after the pre-feeding operation is referred to as "re-feeding").

The feeding amount L2 made by the feeding roller 51 at that time is given by:

$$L2=B^\circ\times\pi\times D/360^\circ \qquad \text{(Formula B)}$$

The feeding amount L2 by the re-feeding is portioned for surely transferring, at least to the pulling roller pair 55, the front end of the sheet S conveyed right before the pulling roller pair 55 by the pre-feeding operation, and the tooth number of the second gear portion 80*e* is selected so that the front end does not reach the register roller pair 81.

Where the control gear 80 rotates further, and where the first cutout portion 80*a* reaches the facing position of the feeding drive gear 65, the feeding drive gear 65 does not receive the drive force, and the drive force is not transmitted to the feeding roller 51. The control gear 80 finishes rotating and stops at the initial position (state shown in FIG. 4(*g*) and FIG. 5(*g*)).

Hereinafter, the reason that the sheet S subjecting to the pre-feeding is temporarily stopped before reaching the pulling roller pair 55 is described.

The feeding roller 51 stops rotating because the control gear 80 does not engage with the feeding drive gear 65. Therefore, the sheet S fed by the feeding amount L1 is stopped in keeping that state. During this period, the intermediate plate 70 is pushed down, by rendering the cam 80*c* contacting with the cam follower 70*c*. If sheets S doubly fed by the pre-feeding operation are located between the feeding roller 51 and the separating roller 53, the feeding roller 51 stopping rotating for a predetermined period starts re-feeding operation after the separating roller 53 performs separating operation, thereby conveying the sheet S to the pulling roller pair 55.

Where the sheet S is made stopped temporarily, the series of operation timings can be made constant from the pre-feeding operation to the re-feeding operation. This makes higher the stability of the sheet conveyance. Moreover, since the sheet S is stopped at a time of releasing the press of the sheet supported by the intermediate plate 70, the front end position of the sheet S can be controlled with high accuracy, and the distance between the nipping portion position between the feeding roller 51 and the separating roller 53 to the pulling roller pair 55 can be made short. This realizes the apparatus to be made compact.

After the intermediate plate 70 pushing the feeding roller 51 is isolated, a certain and stable separating operation is realized because such a separating operation can be made.

Figure 6:
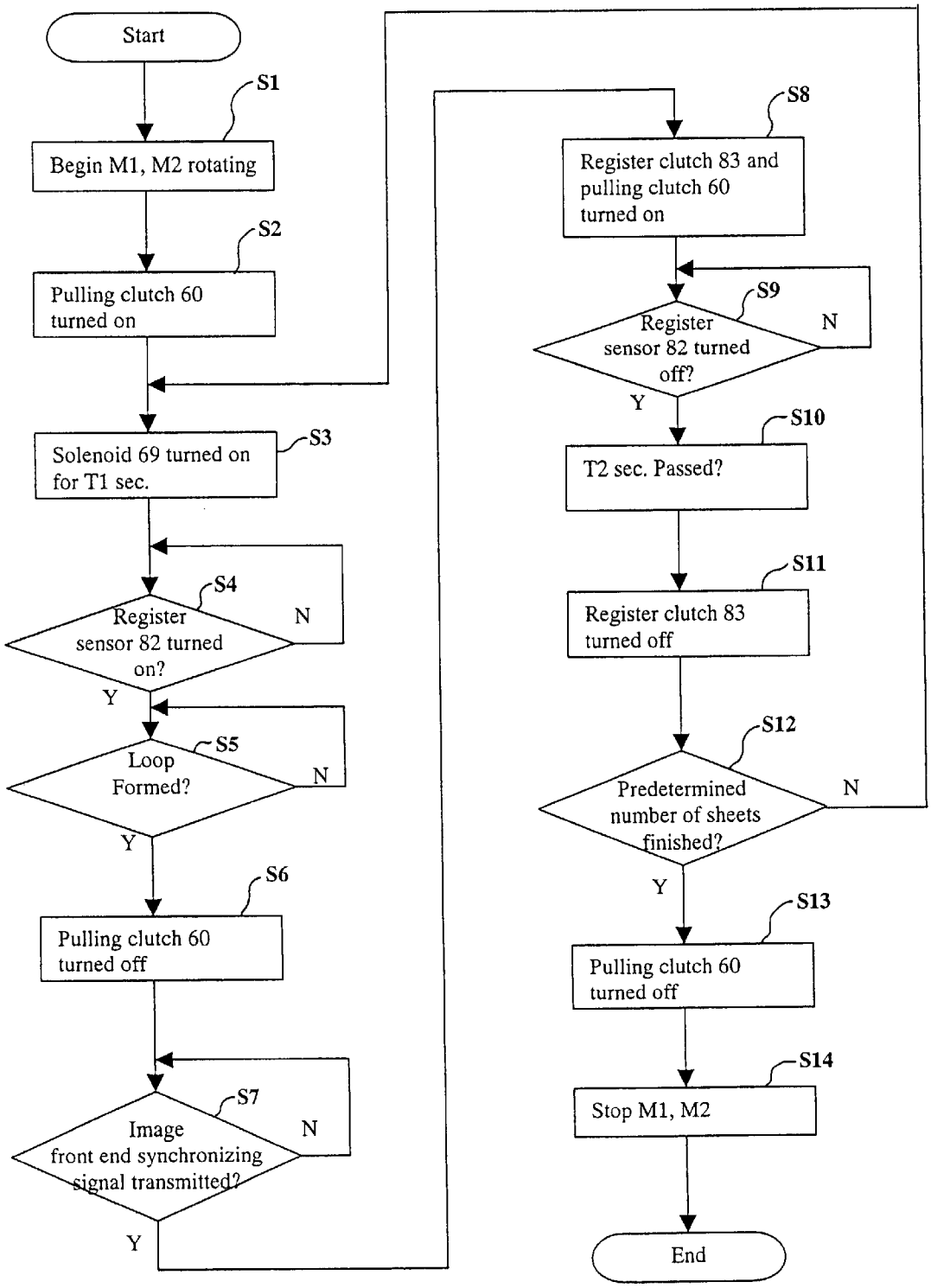
FIG. 6 is a flowchart of manual feeding operation according to the embodiment of the invention.
Figure 7:
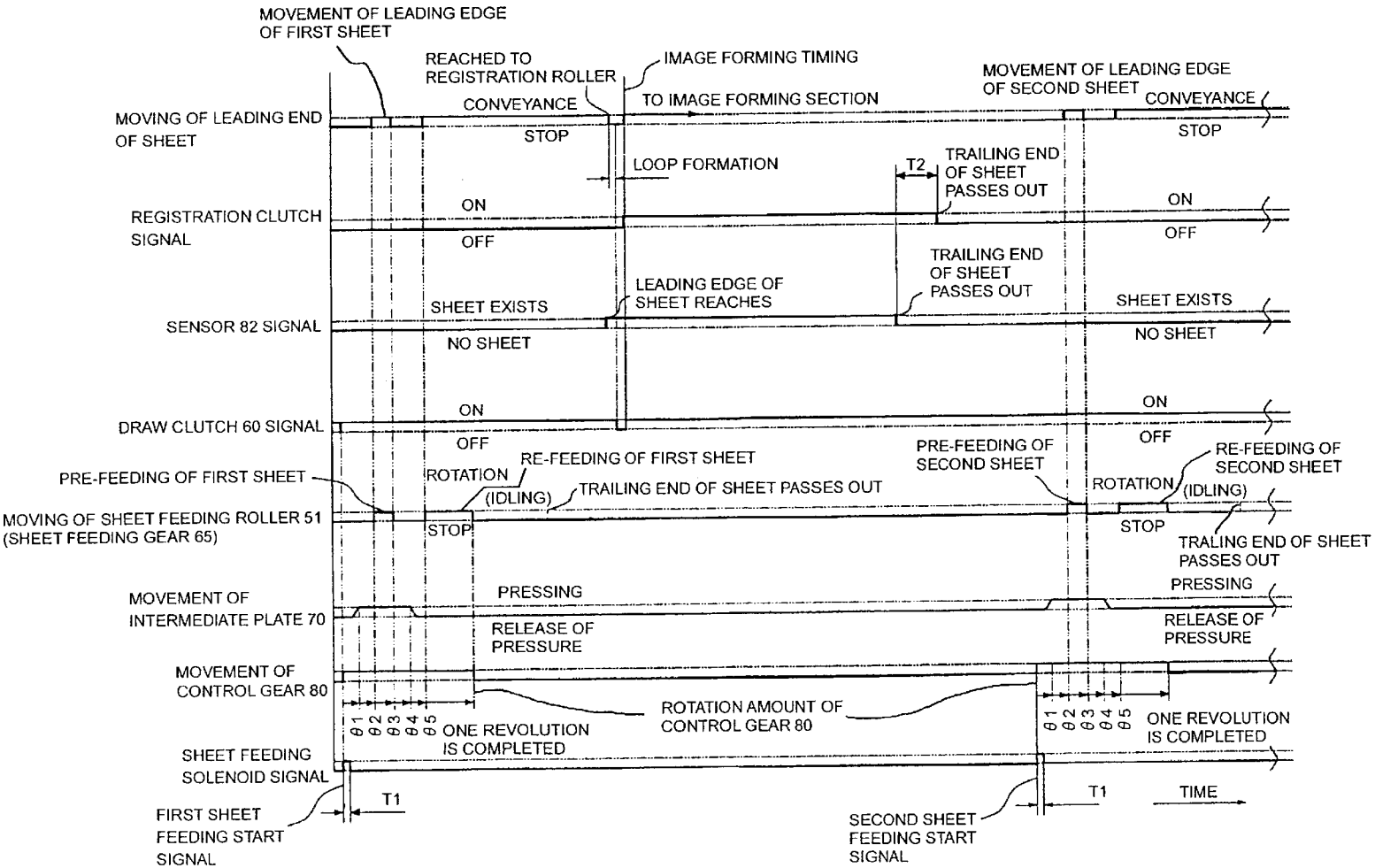
FIG. 7 is a timing chart of the manual feeding operation according to the embodiment of the invention.

Next, referring to a flowchart shown in FIG. 6 and a timing chart shown in FIG. 7, feeding operation done at the multi-feeding section.

Where the sheet bundle is stacked on the feeding tray 74, when a start button not shown is pushed, the pulling motor M2 and the feeding motor M1, respectively start rotating (step 1), and the CPU 40 (see FIG. 1) transmits signals for turning the pulling clutch 60 on (step 2).

After a predetermined time passes, the solenoid 69 is turned on for T1 (sec) upon a signal from the CPU 40 (step 3), thereby starting one turn control of the control gear 80. With this operation, as described above, the sheets supported by the intermediate plate 70 are pressed to the feeding roller 51. Then, the feeding roller 51 rotates only by the predetermined angle A°, and the topmost sheet S stacked on the tray 74 is fed only in a predetermined amount L1 by pressing force of the intermediate plate 70 and frictional force of the surface of the feeding roller 51 (pre-feeding operation).

At that time, because the separating roller shaft 54 rotates in the same direction to the feeding roller shaft 52 in synchrony with the feeding roller shaft 52, predetermined returning force is generated by torque generated by the torque limiter 62. Before the sheet enters in the nipping portion of the feeding roller 51 and the separating roller 53, or when a single sheet only is fed, the frictional force tending to rotate the separating roller 53 in the conveyance direction overcomes the returning force, so that the separating roller 53 rotates together in the feeding direction in following the feeding roller 51. To the contrary, if the two or more sheets are doubly fed (so called double feeding), the returning force overcomes the frictional force between the sheets, and the separating roller 53 operates to return the doubly fed sheets in the direction toward the intermediate plate 70.

Although in the pre-feeding operation, if the sheets are doubly fed, the separating roller 53 may operate to return the doubly fed sheets, the doubly fed sheets may not be returned due to disturbance of separation operation because the intermediate plate 70 presses the feeding roller 51 with the pivotal movement spring 72.

However, the feeding drive gear 65 faces to the second cutout portion 80*b* of the control gear 80 by further rotation of the control gear 80, and the sheets supported by the intermediate plate 70 which presses the feeding roller 51 can be separated where the cam 80*c* and the cam follower 70*c* come in contact with each other after the feeding roller 51 stops rotating.

When the control gear 80 further rotates, the feeding roller 51 starts the refeeding operation, and the conveyance of the sheets, which is being temporarily topped, is restarted to transfer the front end of the sheet S to the pulling roller pair 55. After the conveyance in the prescribed amount L2 by the feeding roller 51 is made during the re-feeding operation, the control gear 80 finishes one turn and stops the drive transmission to the feeding roller 51, but the sheet S is conveyed to the register roller pair 81 since the pulling roller pair 55 continuously rotates.

At that time, because the first cutout portion 80*a* of the control gear 80 is positioned to face to the feeding drive gear 65, the feeding roller 51 is in an unloaded state. The feeding roller 51 receives rotational force from the sheet S conveyed by the pulling roller pair 55, so that the feeding roller 51 rotates together (or idles) until the rear end of the sheet S passes the nipping portion between the feeding roller 51 and separating roller 53.

During this pulling operation, since the intermediate plate 70 is isolated from the feeding roller 51, the sheet to be conveyed next does not receive the frictional force from the feeding roller 51. Though the sheet to be conveyed next is therefore hardly fed doubly, even if the subsequent sheet is fed together, the separating roller 53 starts to rotate reversely to return the doubly fed sheet by operation of the torque limiter at that time because the separating roller shaft 54 coupled to the feeding roller shaft 52 always rotates in the reverse direction to the conveyance feeding direction during the rotational operation of the feeding roller 51 and because the intermediate plate 70 is released from pressing the feeding roller 51 and isolated from the feeding roller 51, so that double feeding is surely prevented.

Where a sheet is jammed at the nipping portion of the feeding roller 51 and the separating roller 53, or where a paper jamming occurs due to some reason or malfunction while a sheet is located at the nipping portion of the pulling roller pair 55, the feeding roller 51 can freely rotate in either direction because the non-tooth portion of the control gear 80 is positioned to face to the feeding drive gear 65. Therefore, the jammed sheets can be pulled in the reverse direction to the conveyance direction, so that the jamming recovery can be handled very easily.

This is accomplished from a structure that the control gear 80 has the toothless portion and that the drives of the feeding roller 51 and the separating roller 53 are coupled to avoid to use a means for restricting rotation such as a one-way clutch or the like.

In other words, while the feeding drive gear 65 is disengaged from the control gear 80, the feeding roller shaft 52 rotates freely, and the feeding roller can rotate in the sheet conveyance direction and the reverse direction thereof Accordingly, the jammed sheets can be pulled in the reverse direction to the sheet conveyance direction.

Where the sheet or sheets are pulled by the conveyance roller pair 55, the feeding roller 51 rotates together, and the separating roller shaft 54 can be rotated in a direction to return the sheets upon transmission of the rotation of the feeding roller 51 to the separating roller shaft 54 through the drive transmission gear 57.

According to the above operation, the front end of the sheet S is conveyed toward the nipping portion of the register roller pair 81 which is being stopped. As shown in FIG. 2, a sheet detection sensor 82 constituted of a photo-interrupter or the like is disposed on the upstream side of the register roller pair 81 and detects the front end of the sheet S (step 4), and a timer means not shown but formed in a CPU 40 for measuring time corresponding to a distance to the register roller pair 81 from the sensor 82 generates a signal controlling a stop timing for the pulling clutch 60 (step 6) so as to form a proper loop between the pulling roller pair 55 and the register roller pair 81(see, state shown in FIG. 5(*h*)).

This loop has been known as a means to correct obliquely feeding of the sheet S. The sheet S is re-conveyed by rotation of the register roller pair 81 upon an image front end synchronizing signal produced by the photosensitive drum 12 or the optical system for exposing the images and fed over the photosensitive drum 12 on the surface of which toner images are transferred.

After a predetermined time T2 (sec) passes after the rear end of the sheet S goes by the sheet detection sensor 82, the register clutch 83 (see, FIG. 2) is turned on (steps 9 to 11) after the rear end of the sheet S surely passes the nipping portion of the register roller pair 81. The sheet S to the surface of which images are transferred is delivered on the delivery tray 25 where the images are fixed by the fixing device 22.

Hereinafter, the same operations are repeated until the prescribed number of sheets finishes (step 12), and when the prescribed number finishes, the pulling clutch 60 is turned off (step 13). This operation ends upon stop of the feeding motor M1 and the pulling motor M2 (step 14).

Referring to FIGS. 8 to 11, a structure around a nipping portion for separation and behavior of the sheet are described.

Figure 8:
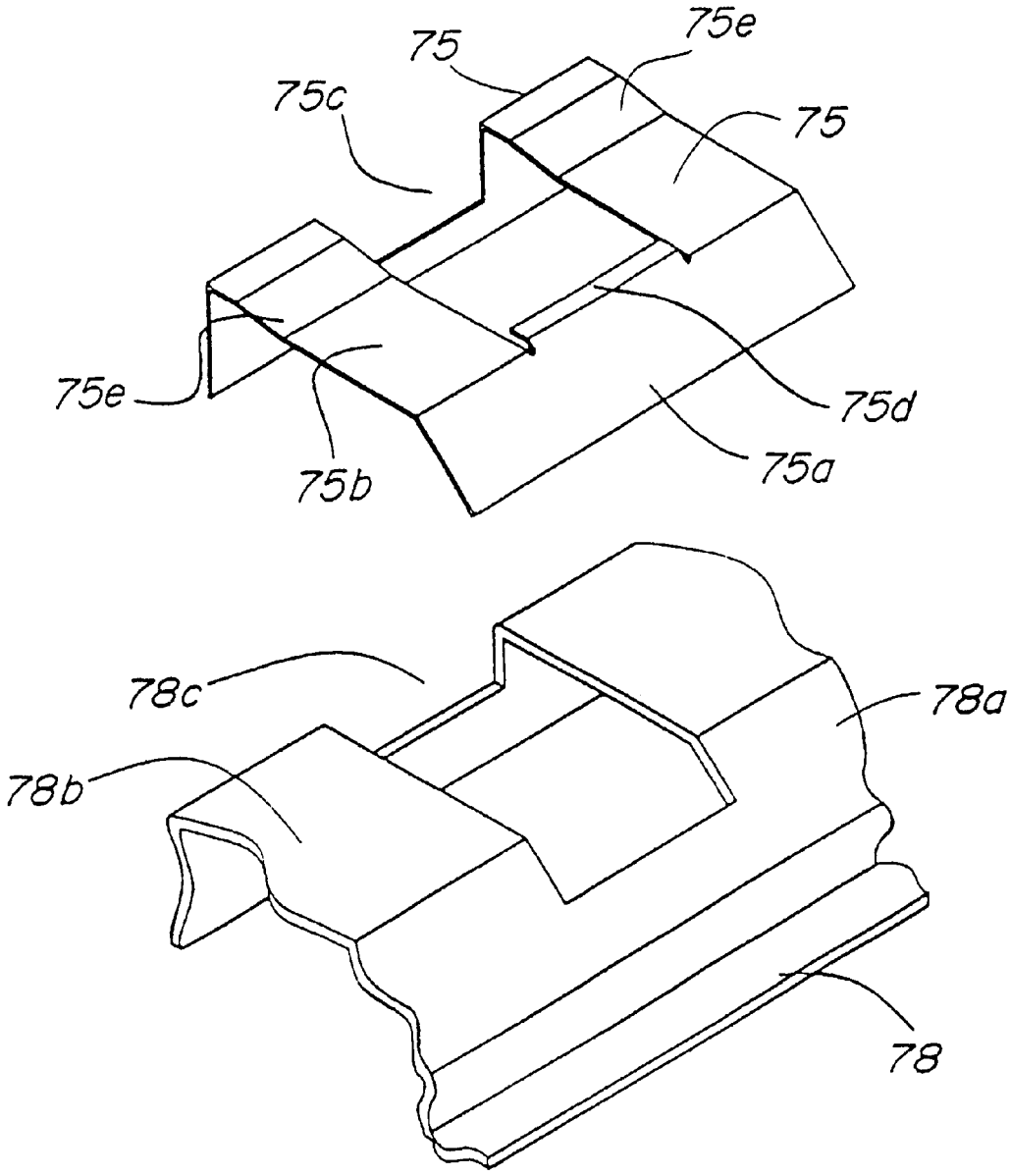
FIG. 8 is a perspective illustration of a separating auxiliary guide.
Figure 9:
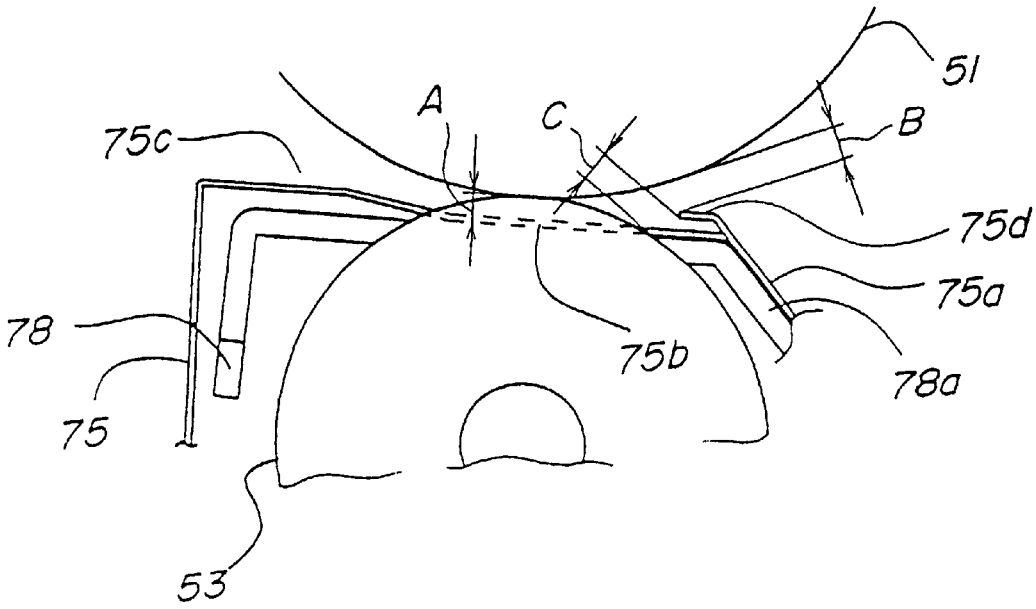
FIG. 9 is a detailed cross section of the separating auxiliary guide.

FIG. 8 is a detailed perspective view of the separating guide 78 and the separating auxiliary guide 75 constituting the conveyance guiding means; FIG. 9 is a detailed cross section around the nipping portion for separation.

The intermediate plate 70 shown in this embodiment is angled with respect to a nipping line created at a contact position between the feeding roller 51 and where the separating roller 53, and the sheet S supported by the intermediate plate 70 is pressed to the feeding roller 51, the sheet S fed out by the feeding roller 51 hits the separating roller 53, thereby conveying the sheet in changing the direction to the nipping line direction.

To guide the sheet, the separating guide 78 is provided as a sheet guide around the separating roller 53, and the separating auxiliary guide 75 is disposed as an auxiliary guide around the separating roller 53 of the separating guide 78.

It is to be noted that although in FIG. 8, the separating guide 78 and the separating auxiliary guide 75, which constitute the conveyance guiding means, are illustrated as divided but actually, in FIG. 9 or the like, they are secured using securing members such as double side tapes and adhesives so that a hitting portion 78*a* of the separating guide 78 and the conveyance guide portion 78*b* are adhered to a parallel guide surface 75*b* formed parallel to the hitting portion 75*a* of the separating auxiliary guide 75 and the nipping line.

The separating guide 78 is formed with the hitting portion 78*a* for hitting the sheet front end when the sheet S is stacked on the feeding tray on the upstream side in the sheet conveyance direction and with the conveyance guide portion 78*b* provided in parallel with the nipping line formed by the feeding roller 51 and the separating roller 53. A folded portion folded toward the separating roller 53 is formed on a further downstream side in the sheet conveyance direction of the conveyance guide portion 78*b*.

The separating guide 78 has a cutout portion 78*c* at the hitting portion 78*a* and the conveyance guide portion 78*b* with an adequate margin as not to contact with the separating roller 53. As for the span in the roller width of the cutout portion 78*c*, the cutout portion 78*c* is cut at a downstream portion in the sheet conveyance direction so that the sheet can be conveyed smoothly even where the fed sheet pulls down the separating roller and sinks in a direction toward the cutout portion 78*c*, and the sheet front end cannot be trapped.

The top surface if the cutout portion 78*c* of the separating guide 78 is located at a position near the nipping portion at the separating auxiliary guide 75 at which the separating roller 53 and the feeding roller 51 come in contact with each other. The separating auxiliary guide 75 is made of a thin plate such as a SUS material and can guide the sheet up to the vicinity of the separating nipping portion. The opposing ends of the separating auxiliary guide 75 at the separating nipping portion in the roller width direction is wider than the roller width of the separating roller 53, and the separating auxiliary guide 75 ensures space A with the feeding roller 51 projecting up to the top surface of the separating auxiliary guide 75, thereby conveying the sheets surely.

An auxiliary hitting portion 75*a* is arranged parallel to the hitting portion 78*a* of the separating guide so as to cover the cutout portion of the separating roller 53 formed at the hitting portion 78*a* of the separating guide 78 on the upstream side in the sheet conveyance direction of the separating auxiliary guide 75.

The upstream portion in the sheet conveyance direction of the separating nipping portion of the separating auxiliary guide 75 forms an upstream portion guide surface 75*d* which is disposed so as to project upward from parallel guide surface 75*b* toward the separating roller 53 and the feeding roller 51, respectively wherein the width amount of cutout portion 75*c* is the same as the width of the separating roller with respect to the nipping line. The interval B to the feeding roller 51 at that time takes a minimum distance so as not to create conveyance resistance when the topmost sheet enters in the nipping portion including the clearances of the parts and plays of the bearings, and the interval C to the separating roller 53 is set to a minimum distance so that the separating roller 53 does not contact with the upstream portion guide surface 75*d* even where relative positional relation is change 4*d* due to the clearances of the parts and plays of the bearings. It is to be noted that, more specifically, it is preferable to set the interval A to be of around 0.6 to 0.9 mm, the interval B to be of around 1 to 2 mm, and the interval C to be of around 1 to 1.5 mm, from a viewpoint to separation performance.

The upstream portion guide surface 75*d* is positioned closer to the feeding roller 51 in the vertical direction than the parallel guide surface 75*b,* so that the end on the nipping side of the upstream portion guide surface 75*d* can be formed near the round peripheral surface of the feeding roller 51 and the separating nipping portion.

A cutout portion 75*c* at which a span of the roller width of the separating roller 53 is cut out is formed on a downstream side in the sheet conveyance direction of the separating nipping portion of the separating auxiliary guide 75.

A lifting inclined surface 75*e* which is inclined as coming closer to a side of the feeding roller 51 as going downstream in the sheet conveyance direction, is formed on each opposite end in the roller width of the separating roller 53 on a downstream side in the sheet conveyance direction of the separating nipping portion.

The behavior of the sheets where the conveyance guide near the separating nipping portion is formed with this structure is described below.

First of all, a case where sheets having a thin thickness and a low rigidity are fed is described. The front end of the sheet hits the outer peripheral surface of the separating roller rotating together with the rotation of the feeding roller 51, and the sheet is guided to the separating nipping portion as curving along the rotation of the feeding roller 51. The doubly fed sheets are separated at the separating nipping portion by the separating roller 53 in rotating in the reverse direction with a prescribed torque, and the topmost sheet only is fed.

The sheet is conveyed in substantially parallel to the nipping line of the separating nipping portion, the tangential line of the contact portion and then conveyed to the pulling roller pair 55 formed on a downstream side in the sheet conveyance direction of the separating nipping portion.

Figure 10:
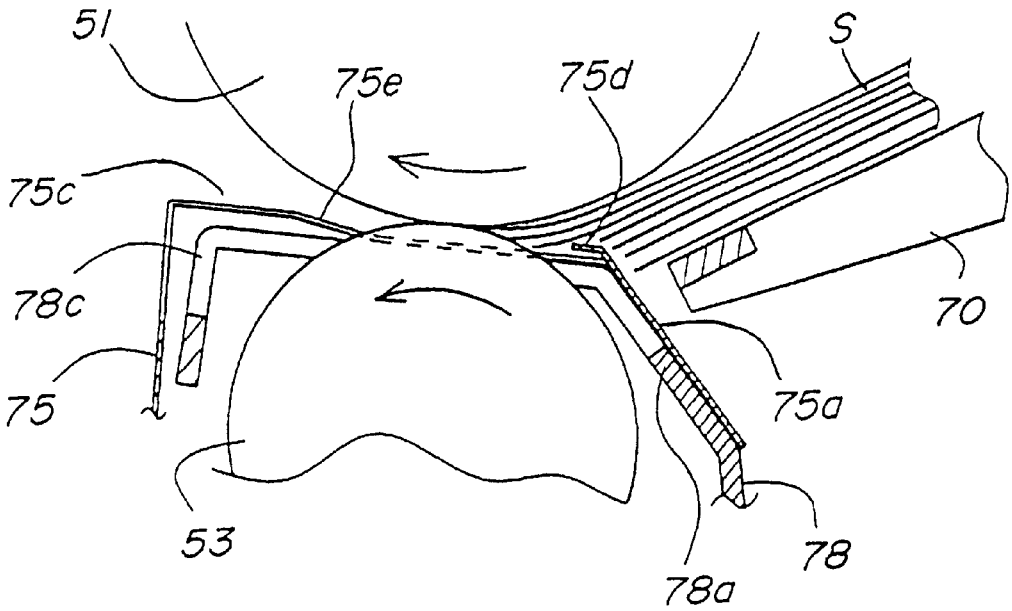
FIG. 10 is a cross section of an essential portion of a separation nipping portion.
Figure 11A:
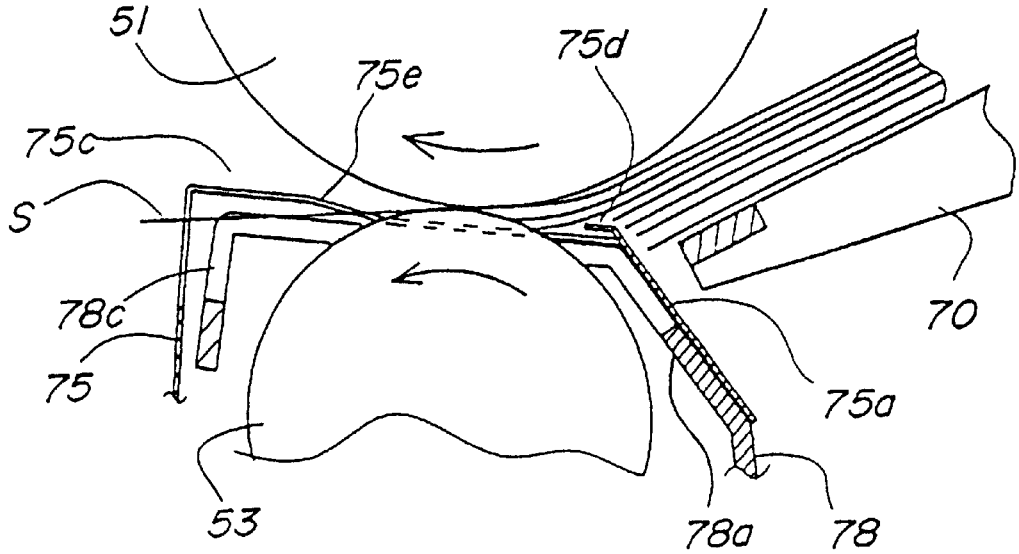
FIG. 11(*a*) is a cross section of an essential portion of the separation nipping portion around a center of a cutout portion.
Figure 11B:
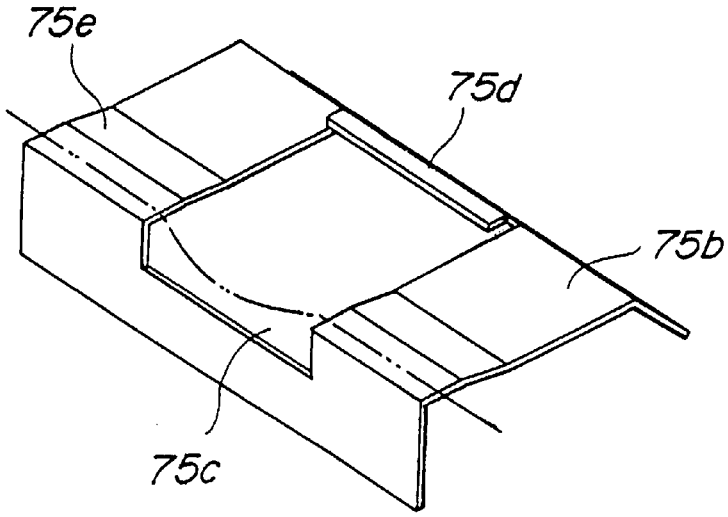

Referring to FIG. 10 and FIG. 11, a case where sheets have a thick thickness and a high rigidity are fed is described. FIG. 10 and FIG. 11(*a*) are cross sections showing portions around the separating nipping portion located at a center in the roller width direction of the separating roller 53; FIG. 11(*b*) is a diagram showing with double dot chain lines the sheet front end curving as to fall in the cutout portion.

The thick sheet having a high rigidity presses to the feeding roller 51 according to a positional shift of the intermediate plate 70, and the front end of the sheet hits the outer peripheral surface of the separating roller 53 upon reception of the rotation of the feeding roller 51. At that time, the upstream portion guide surface 75*d* of the separating auxiliary guide 75 is arranged at a position near the outer peripheral surface of the feeding roller 51, so that the sheets other than the topmost sheet among the doubly fed sheets are stopped by this upstream portion guide surface 75*d*.

This upstream portion guide surface 75*d* reduces the number of the doubly fed sheets otherwise entering into the separating nipping portion, thereby weakening the rigidity of the sheet bundle hitting the separating roller 53 as a whole, and thereby reducing the hitting angle on the separating roller 53.

That is, by rendering the sheets contact with the separating roller 53 in a direction closer to the tangential line of the separating roller 53, force given from the sheets to the separating roller 53 and exerted in a direction that the separating roller 53 separates from the feeding roller 51 can be greatly reduced. This is an advantage brought from the upstream portion guide surface 75*d* placed near the round peripheral surface of the feeding roller 51 and the separating nipping portion.

The sheet front end hitting the separating roller 53 enters in the separating nipping portion in slightly curving and is separated from the sheets other than the first sheet by the separating roller 53 (see, FIG. 10).

The sheet is shifted toward the feeding roller 51 by the inclined surface 75*e* of the separating auxiliary guide on the downstream side in the sheet conveyance direction of the separating nipping portion. This prevents the sheet from sinking in a direction toward the separating roller 53, thereby preventing the separating roller 53 from moving in a direction isolating from the feeding roller 51.

That is, the rear end of the sheet, by the upstream portion guide surface 75*d* on the upstream side of the separating nipping portion, and the front end of the sheet, by the inclined surface 75*e,* are shifted toward the feeding roller 51 to render the sheet conveyance direction equal, as much as possible, to the nipping line, or namely the tangential line of the feeding roller 51 and the separating roller 53, so that this apparatus can prevent the separating pressure, which is given from the separating roller 53 to the feeding roller 51, from being reduced, and thereby stable feeding operation is guaranteed.

The sheet may curve at the cutout portion 75*c* as to enter toward the separating roller 53 as shown in FIG. 11(*b*), because the separating auxiliary guide 75 and the separating guide 78 are cut out, right behind the separating roller 53 on the downstream side in the sheet conveyance direction.

However, because the separating guide 78 and the separating auxiliary guide 75 have the cutout portions 78*c,* 75*c* in the range of the separating roller width, the sheet can be conveyed without hitting of the curved sheet front end against the separating guide 78 and the separating auxiliary guide 75.

Although in this embodiment a sheet feeding apparatus in which sheets are conveyed to the separating nipping portion by pressing the intermediate plate to the feeding roller is described, this invention is applicable to a sheet feeding apparatus in which a pickup roller is provided on an upstream side of the feeding roller to feed the sheets up to the separating nipping portion.

Although in this embodiment a sheet feeding apparatus to which this invention applies applying to the multi-feeding section is exemplified, this sheet feeding apparatus is applicable to a cassette feeding sections and deck feeding sections.

Although in this embodiment the invented sheet feeding apparatus is described as applying to the photocopier as an image forming apparatus, this invention is not limited to this. For example, an image reading apparatus can be made by providing an image reading section for reading image information recorded on the sheets on a downstream side in the sheet conveyance direction of the sheet feeding apparatus of the invention.

In FIG. 9, the intervals at the separating roller 53 and the separating auxiliary guide 75 are defined as A, B, and C, and a preferable setting of distances is described to properly implement the feeding and separating operation, but as described above, keeping desired distances during the assembly of the apparatus may be difficult due to clearances of parts, plays or deviations of bearings, and like. In this invention, a positioning means for the feeding roller 51 is formed as described below for facilitating the users and the service persons to adjust the improper portions occurring during the assembly of the apparatus or after installation of the apparatus.

Figure 13B:
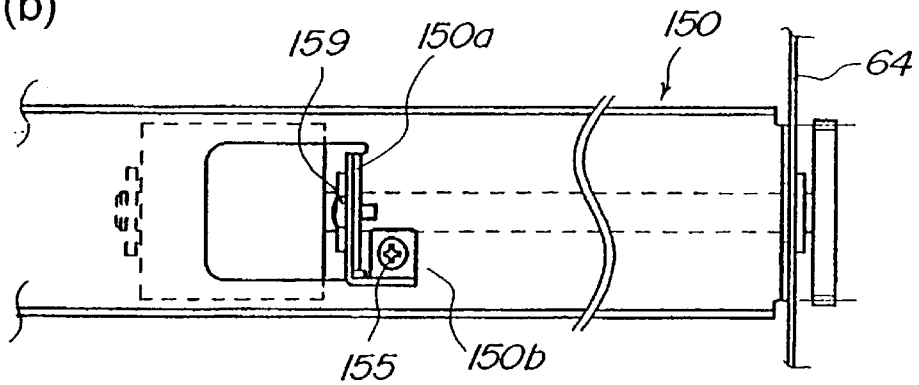
FIGS. 13(*a*), 13(*b*), and 13(*c*) are illustrations of a positioning means for adjusting a position of a feeding roller.
Figure 13C:
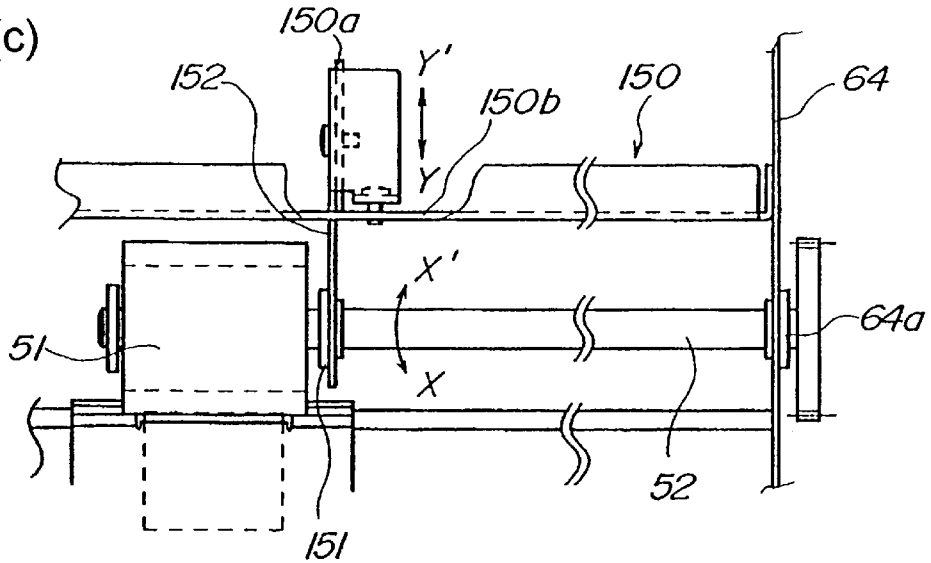
Figure 13A:
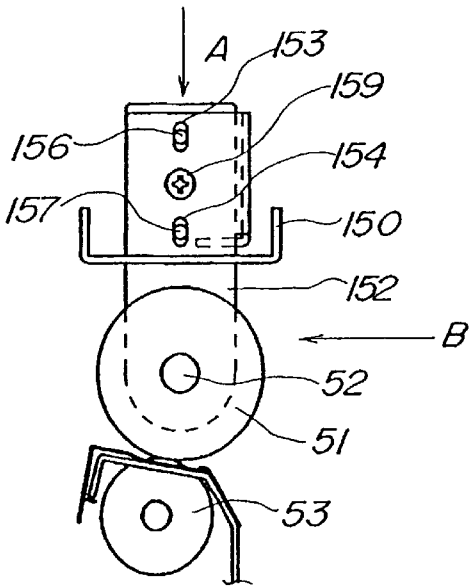
Figure 14A:
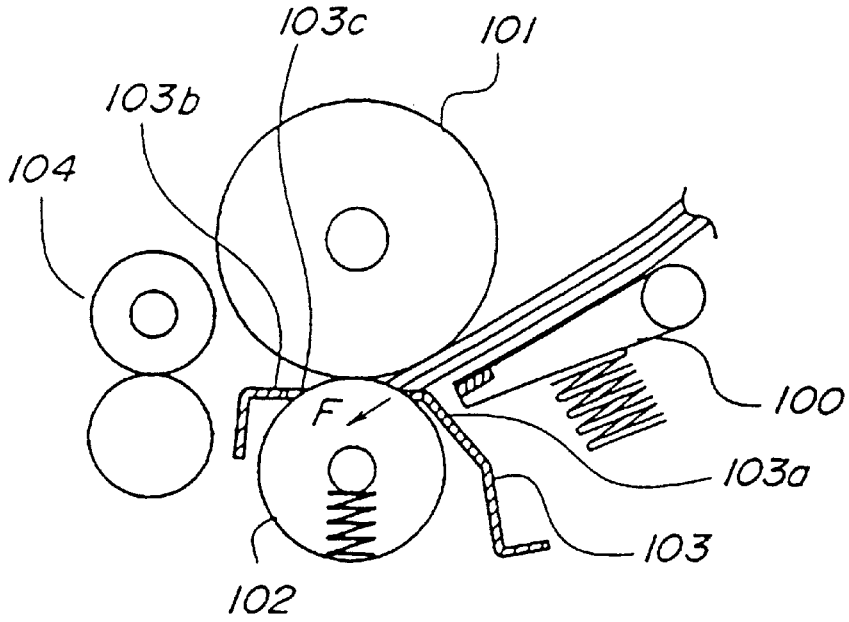
FIG.14(a) PRIOR ART
FIGS. 14(*a*) and 14(*b*) are illustrations of an essential portion of a conventional manual feeding portion.
Figure 14B:
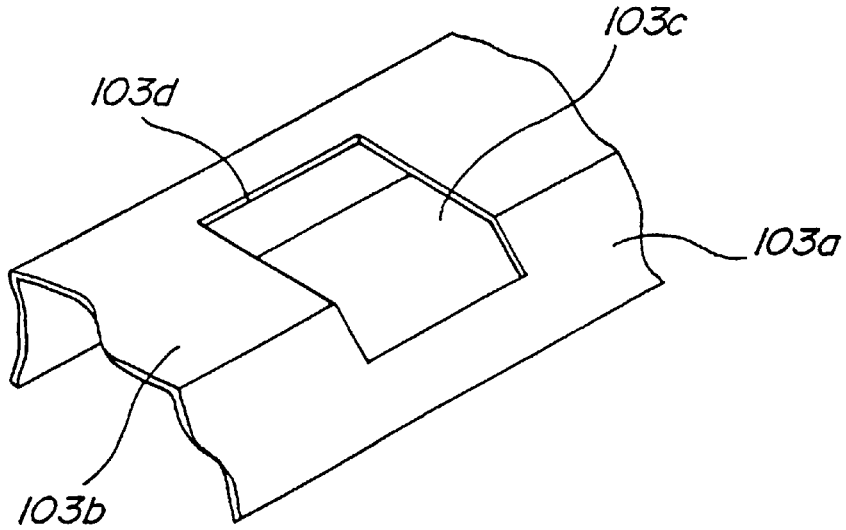
FIG.14(b) PRIOR ART

FIG. 13(*a*) is a diagram of a vicinity of a feeding roller 51 when seen in a direction of a feeding roller shaft; FIG. 13(*b*) is a diagram when seen in a direction of A in FIG. 13(*a*); FIG. 13(*c*) is a diagram when seen in a direction of C in FIG. 13(*a*). Numeral 150 is a stay formed parallel to the feeding roller shaft 52 over the feeding roller shaft 52 and secured to the front side plate 63 and the rear side plate 64. It is to be noted that parts on the side of the front side plate 63 are omitted in FIG. 13.

A positioning arm 152 is engaged with a bearing 152 as a positioning mean extending in the direction of the stay 150 and extending perpendicular to the roller shaft. The positioning arm 152 is projecting over the stay 150 through a hole formed in the stay 150, and holes 153, 154 and screwing holes not shown are formed as shown in FIG. 13(*a*) in a side surface of the arm 152. It is to be noted that the holes 153, 154 are engaged with pins 156, 157 formed at a curving portion 150*a* as described below and have a long hole shape so as to make the arm 152 movable in the vertical direction. The screwing hole has a larger diameter by an adjusting margin than the long hole or screw diameter in the vertical direction in FIG. 13(*a*).

The stay 150 has the curving portion 150*a* cut and raised, and the curving portion 150*a* is formed as described above with the pins 156, 157 to engage with the holes 153, 154 of the positioning arm 152. A tap, not shown, is made at a position corresponding to the screwing hole, and the positioning arm 152 is secured to the curving portion 150*a* with screws 159.

The positioning arm 152 is urged downward (guide direction) by a screw 155 against the tap not shown formed at a top surface 150*b* of the stay 150. Therefore, when the screw 155 is loosened, and when the positioning arm 152 is disengaged from the secured state, the positioning arm 152 becomes movable in the guide direction upon loosening the screw 155 restricting the move in the vertical direction of the positioning arm 152 because the holes 153, 154 formed in the positioning arm 152 are long holes extending longer in the vertical direction and because the screwing hole not shown through which the screw 159 penetrates has a larger diameter by the movable amount.

That is, where the screw 155 is turned in a tightening direction with respect to the stay 150, the positioning arm 152 moves in a direction of arrow Y, and where the screw 155 is turned in a loosening direction with respect to the stay 150, a play occurs with respect to a direction of arrow Y', thereby rendering the positioning arm movable.

As described above, since the positioning arm 152 engages with the bearing 152 formed at the feeding roller shaft 52, the feeding roller shaft 52 can be moved in a direction of arrow X or a direction of arrow X' upon rotating the screw 155. That is, the position of the feeding roller 51 can be shifted by rotating the screw 155 to move the positioning arm 152 in the vertical direction (Y–Y' direction). Where the position of the feeding roller 51 is thus shifted, the intervals A, B, and C properly set for sheet feeding which is set between the separating roller 53 and the separating auxiliary guide 75 can be adjusted easily.

It is to be noted that in FIG. 13, because the feeding roller shaft 52 is cantilevered to the rear side plate 64, if the positioning arm 152 moves in the vertical direction, the feeding roller shaft 52 moves in a direction of arrow X–X' in FIG. 13(*c*), or namely moves pivotally around a bearing 64*a*, as a center, of the rear side plate 64 on which the shaft 52 is supported.

This may make nipping portion formed in contact between the feeding roller 51 and the separating roller 53 not strictly parallel to the sheet conveyance direction, but the inclined angle that the feeding roller shaft 52 is inclined from the horizontal line due to shifts of the positioning arm 152 in the vertical direction is very slight because the moving amount of the positioning arm 152 in the vertical direction is slight with respect to the distance from the bearing 64*a* to the feeding roller 51. Accordingly, the movements of the feeding roller shaft 52 in the pivotal movement direction in this structure may not affect the sheet feeding operation.

It is to be noted that where the feeding roller shaft 52 is supported to the front and rear side plates, or namely where each end of the shaft is supported to each bearing, the feeding roller shaft 52 can be structured to allow the roller position in the vertical direction to shift freely to some extent, likewise of universal joint and to allow each end of the roller 51 to be shifted in the same amount in the vertical direction by providing the positioning arm 152 on each side of the feeding roller 51.

Figure 12A:
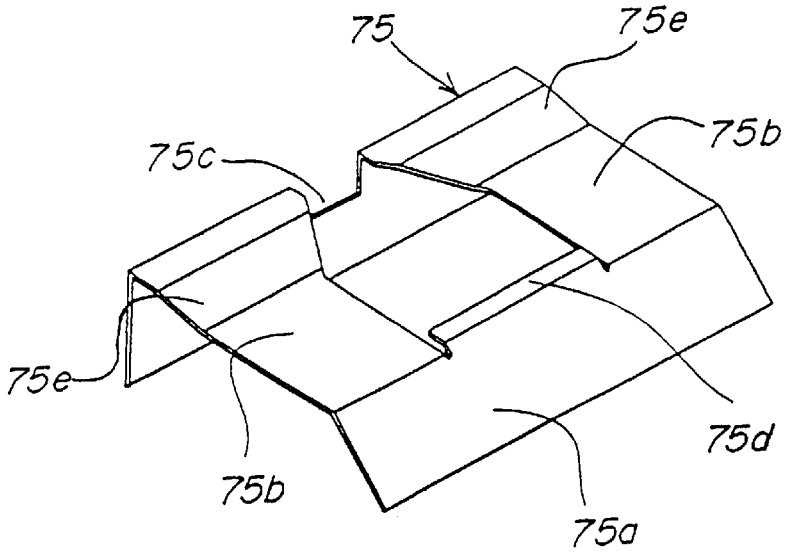
FIGS. 12(*a*) and 12(*b*) are perspective illustrations of a separating auxiliary guide according to an additional embodiment.
Figure 12B:
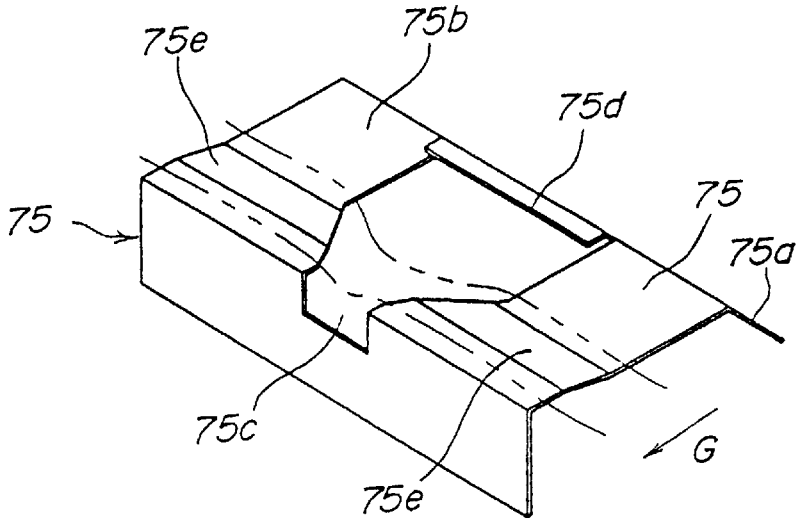

Referring to FIG. 12, an additional embodiment is described next. FIG. 12(*a*) is a perspective illustration of a separating auxiliary guide of the additional embodiment when seen on an upstream side; FIG. 12(*b*) is a perspective illustration of the separating auxiliary guide when seen on a downstream side.

In this embodiment, the shape of the separating auxiliary guide 75 is different from the shape in the aforementioned embodiment as described above, and the structure of portions other than specially described is substantially the same as in the aforementioned embodiment. The portions having the same function or functions to the separating auxiliary guide in the aforementioned embodiment have the same reference numbers as in the aforementioned embodiment.

The cutout portion 75*c* of the separating auxiliary guide 75 located on the downstream side of the separating nipping portion is structured to have an opening becoming gradually narrower as going downstream further n the sheet conveyance direction.

In FIG. 12(*b*), the state of the sheet front end is shown by double dot chain lines. The sheet front end passing the separating nipping portion and going behind at the cutout portion 75*c* in curving toward the separating roller 53 gradually reduces the curving amount as going in a direction of arrow G as shown in FIG. 12(*b*) with the double dot chain lines because the cutout portion 75*c* becomes narrower, so that the front end can enter easily in the nipping portion of the pulling roller 55 located on the downstream side.

As described above, because the conveyance guide means for guiding the sheet feeding has a guide surface 75*b* located on a side of the separating roller 53 with respect to the nipping position at which the feeding roller 51 and the separating roller 53 are in contact with each other, and because the projection guide portion 75*d* projecting on a side of the intermediate plate 70 with respect to the nipping position at which the feeding roller 51 and the separating roller 53 as well as on a side of the feeding roller 51 with respect to the guide surface 75*b,* the sheet front end having a high rigidity and a high frictional coefficient is treated and guided to be in parallel to the nipping line, thereby rendering the feeding operation sure.

The conveyance guide 75*e* for guiding the sheets located on a downstream side in the sheet conveyance direction with respect to the nipping portion between the separating roller 53 and the feeding roller 51 is formed on a side of the nipping line with respect to the level of the conveyance guide 75*b* at the nipping portion, so that the sheet can be prevented from sinking on a side of the separating roller 53.

The sheet guide surface opposing to the intermediate plate with respect to the nipping position at which the feeding roller 51 and the separating roller 53 are in contact with each other is bent toward the side of the separating roller 53, and the guide at the curving portion is formed with the cutout portions 75*c,* 78*c* at which a range in the roller width direction of the separating roller 53 is cut out, so that the sheet front end curving and sinking on a side of the separating roller 53 can be prevented from hitting the guide.

As described above, the conveyance guiding means of the invention is thus structured, and therefore, the sheets, even though having a high rigidity and a high frictional coefficient, can be surely fed without subjecting to double feeding or failures of feeding.

What is claimed is:

1. A sheet feeding apparatus comprising:

sheet supporting means movable for supporting a sheet or sheets;

a sheet feeding rotary member in contact with the sheet supported by the sheet supporting means to feed out the sheet upon rotation of the feeding rotary member, and a separating rotary member forming a contact portion in contact with the feeding rotary member and being rotatable in a direction returning the sheet to separate the sheet fed out of the feeding rotary member one by one, wherein the sheet supporting means, the feeding rotary member, and the separating rotary member are so disposed that an angle formed on a side of the feeding rotary member by intersecting a tangential line of the feeding rotary member at a contacting position between the feeding rotary member and the sheet with a tangential line at the contact portion is an obtuse angle, and further comprising conveyance guiding means having a guide surface adjacent to the contact portion for guiding the sheet fed by the feeding rotary member to the contact portion, the conveyance guiding means having a projection guiding means projected a greater amount toward the feeding rotary member on an upstream side in the sheet conveyance direction of the contact portion than the guide surface and the conveyance guide means having an inclined portion more inclined toward the feeding rotary member on an downstream side in the sheet conveyance direction of the contact portion than the guide surface.

2. The sheet feeding apparatus according to claim 1, wherein the conveyance guiding means has a folded portion in which an end on a downstream side in the sheet conveyance direction of the contact portion is folded toward the separating rotary member at about right angle.

3. The sheet feeding apparatus according to claim 1, wherein the conveyance guiding means has a cutout portion in which the guide surface is cut out on a downstream side in the sheet conveyance direction of the separating rotary member.

4. The sheet feeding apparatus according to claim 3, wherein the cutout portion is so formed to narrow a cutout range as going toward the downstream side of the sheet conveyance direction from the separating rotary member.

5. The sheet feeding apparatus according to claim 1, wherein the conveyance guiding means is for guiding the sheet located around a position at which the feeding rotary member and the separating rotary member are formed, and the conveyance guiding means is secured to a sheet guide for guiding the sheet for the full width of the sheet.

6. The sheet feeding apparatus according to claim 1, further comprising a positioning means for adjusting an interval between the conveyance guiding means and the feeding rotary member.

7. The sheet feeding apparatus according to claim 6, wherein the positioning means includes a positioning arm in engagement with a shaft holding the feeding rotary member, and a stay for securing the positioning arm disposed over the feeding rotary member, and wherein the position of the feeding rotary member with respect to the conveyance guiding means is adjusted by moving the positioning arm secured to the stay in a direction perpendicular to the shaft.

8. The sheet feeding apparatus according to claim 1, wherein a distance from the contact portion between the feeding rotary member and the separating rotary member to the guide surface around the contact portion of the conveyance guiding means is set to be 0.6 mm to 0.9 mm.

9. The sheet feeding apparatus according to claim 1, wherein the separating rotary member is formed with a torque limiting means for providing a predetermined torque to the separating rotary means.

10. The sheet feeding apparatus according to claim 1, further comprising conveying means disposed on a downstream side in the sheet conveyance direction of the feeding rotary member for conveying sheets fed out of the feeding rotary member.

11. An image forming apparatus comprising:

the sheet feeding apparatus as set forth in any one of claims 1 and 2 to 10; and image forming means for forming an image on a sheet fed out of the sheet feeding apparatus.

12. An image reading apparatus comprising:

the sheet feeding apparatus as set forth in any one of claims 1 and 2 to 10; and image reading means for reading an image on a sheet fed out of the sheet feeding apparatus.

* * * * *

UNITED STATES PATENT AND TRADEMARK OFFICE

CERTIFICATE OF CORRECTION

PATENT NO. : 6,536,759 B1
DATED : March 25, 2003
INVENTOR(S) : Hideaki Takada

It is certified that error appears in the above-identified patent and that said Letters Patent is hereby corrected as shown below:

Title page,
Item [56], References Cited, U.S. PATENT DOCUMENTS, "HIroi et al." should read -- Hiroi et al. --.

Column 1,
Line 35, "prescribe" should read -- prescribed --.

Column 6,
Line 17, "com" should read -- cam --.
Line 23, "enable" should read -- enables --.
Line 35, "as" should read -- so as --.

Column 9,
Line 32, "thereof" should read -- thereof. --.

Column 11,
Line 21, "change" should read -- changed --.

Column 14,
Line 63, "n" should read -- in --.

Column 15,
Line 51, "sheet" should read -- sheets --.

Column 16,
Line 5, "an" should read -- a --
Line 11, "right" should read -- a right --.
Lines 55 and 61, "claims 1 and 2 to 10;" should read -- claims 1 to 10; --.

Signed and Sealed this

Twenty-first Day of October, 2003

JAMES E. ROGAN
*Director of the United States Patent and Trademark Office*